United States Patent [19]

Ashline

[11] 4,433,638

[45] Feb. 28, 1984

[54] AUTOMATIC FLOTATION RELEASE SYSTEM

[76] Inventor: Clifford E. Ashline, 5 Wilcox Blvd., Harahan, La. 70123

[21] Appl. No.: 311,153

[22] Filed: Oct. 13, 1981

[51] Int. Cl.[3] ..... B63B 45/00

[52] U.S. Cl. ..... 116/210; 340/984; 441/7

[58] Field of Search ..... 116/210; 441/7, 6, 9, 441/11, 12, 10; 340/870, 16, 22, 603, 29; 455/99, 96, 98, 95

[56] References Cited

U.S. PATENT DOCUMENTS

| | | | |
|---|---|---|---|
| 2,470,783 | 5/1949 | Mead | 116/210 X |
| 2,923,917 | 2/1960 | McPherson et al. | 340/27 R |
| 3,035,285 | 5/1962 | Squires, Jr. | 116/210 X |
| 3,123,842 | 3/1964 | Oeland, Jr. et al. | 116/210 |
| 3,332,390 | 7/1967 | Ashline | 441/30 X |
| 3,341,871 | 9/1967 | Oliveau | 441/10 |
| 3,676,779 | 7/1972 | Fauiring et al. | 116/210 X |
| 3,893,202 | 7/1975 | Higgs et al. | 441/3 |
| 4,102,296 | 7/1978 | Felix | 116/210 |
| 4,295,438 | 10/1981 | Porter | 441/9 |

FOREIGN PATENT DOCUMENTS

| | | | |
|---|---|---|---|
| 1479266 | 7/1977 | United Kingdom | 441/9 |

*Primary Examiner*—Daniel M. Yasich

*Attorney, Agent, or Firm*—Harvey B. Jacobson

[57] ABSTRACT

An aerial lift balloon and signalling components attached thereto are stored within a closure member held assembled with a breakaway housing to form a package storing an inflating device for the balloon. Removal of the closure member initiates inflation of the balloon and operation of the signalling components, while removal of an end cover of the package permits separation of the breakaway housing enabling the positioning of the inflating device by a flotation collar portion of the package for aerial launching of the balloon with the signalling components suspended therefrom.

20 Claims, 10 Drawing Figures

50
64
76
56
58
60
62
124
26
24
42
22
12
18
20
16
128

50
76
24
36
26
64
56
58
60
62
22
16
12
18
20

10
12
16
18

12
10
18

AUTOMATIC FLOTATION RELEASE SYSTEM

BACKGROUND OF THE INVENTION

This invention relates to emergency location signalling devices of the type disclosed in my prior U.S. Pat. No. 3,253,573, with respect to which the present invention is an improvement.

Location marking devices that are automatically released, launched and triggered into operation are well known as disclosed in my prior U.S. Pat. Nos. 3,253,573 and 3,332,390. The automatic release of a marker buoy anchored to a submerged craft, and from which an aerial balloon is launched, is also known as disclosed in U.S. Pat. No. 2,470,783 to Mead. Also known are radio and light signalling components suspended from an inflated balloon anchored by a cable to its storage enclosure, as disclosed in U.S. Pat. No. 2,923,917 to McPherson. Other possibly relevant emergency location signalling devices are disclosed in U.S. Pat. Nos. 2,821,725 and 4,102,296.

Such prior art location signalling arrangements often require special craft or vehicle mounting facilities and/or impact responsive release means that create installation problems and introduce a certain degree of unreliability such as unintended trigger. It is therefore an important object of the present invention to provide a portable type of location signalling unit that may be carried by any type of vehicle or craft and triggered into operation either manually or automatically.

SUMMARY OF THE INVENTION

In accordance with the present invention, a flotation collar is tightly mounted on a compressed gas inflating cylinder of a portable unit to floatingly support the cylinder in water for aerial launching of a lift balloon stored within a signal cover assembled in abutment with the flotation collar to hold a releasable trigger mechanism in a latched condition. Separable breakaway housing sections are held assembled between the flotation collar and an inspection cover at the opposite axial end of the unit housing package having a signal cover to form a launching guide assembly and protectively enclose various components including the inflation cylinder and associated inflating mechanism, the aerial balloon device and associated check valve and releasable coupling mechanism, and cable storage means for anchoring and interconnecting cable lines. Signalling components including a radio transmitter, strobe light and batteries are also stored in the signal cover interconnected by suspension cable to the aerial balloon device. Removal of the inspection cover exposes one end of the inflation cylinder for servicing, while removal of the signal cover triggers operation of the signalling components and initiates inflation of the balloon.

The signal cover may be automatically removed by buoyancy forces acting on the unit package in response to submerging of a craft on which the unit is carried with the end covers anchored by cable to the craft. Such removal of the covers causes separation of the breakaway housing section enabling the flotation collar to properly orientate the inflation cylinder at the water surface for aerial launching of the expanding balloon released upon removal of the signal cover. The floated inflation cylinder remains anchored by cable to the submerged craft while the balloon remains anchored to the cylinder with the operating signalling components suspended therefrom.

These together with other objects and advantages which will become subsequently apparent reside in the details of construction and operation as more fully hereinafter described and claimed, reference being had to the accompanying drawings forming a part hereof, wherein like numerals refer to like parts throughout.

FIGS. *7a, 7b, 7c* and *7d* are simplified side elevation views showing sequential automatic operation of the location signalling unit in response to sinking of a marine craft on which the unit is carried.

DETAILED DESCRIPTION OF THE PREFERRED EMBODIMENT

Figure 1:
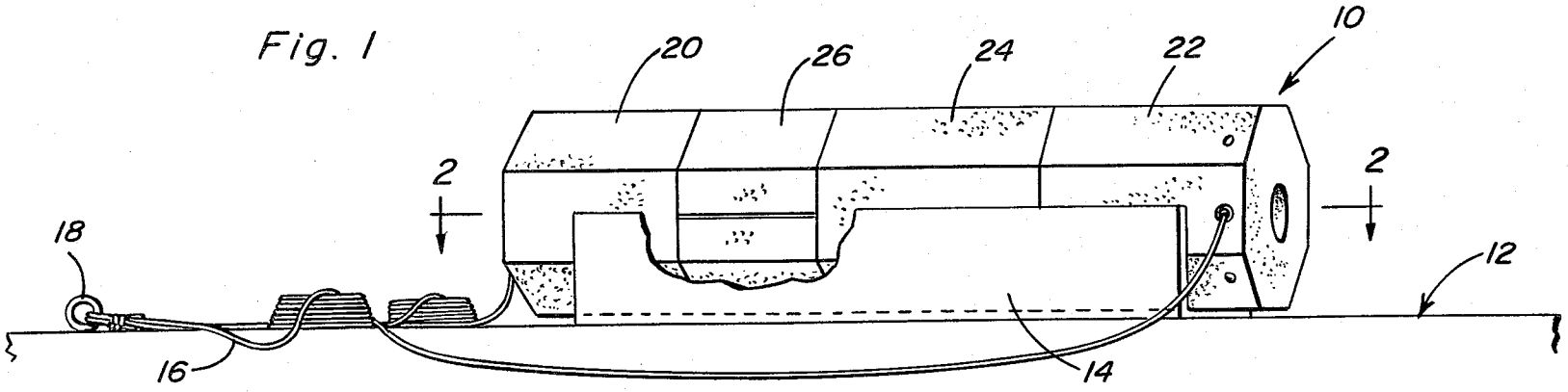
FIG. 1 is a side perspective view of an installed location signalling unit constructed in accordance with the present invention, with a portion of the installation broken away.

Referring now to the drawings in detail, FIG. 1 illustrates a typical emergency location indicating unit constructed in accordance with the present invention, and generally referred to by reference numeral 10. The unit is shown carried on some vehicle or craft 12, by means of a holding rack 14 from which the unit may be removed for servicing. Further, the unit may be loosely anchored to the craft 12 by means of a cable 16 secured to some anchoring hardware 18.

Figure 2:
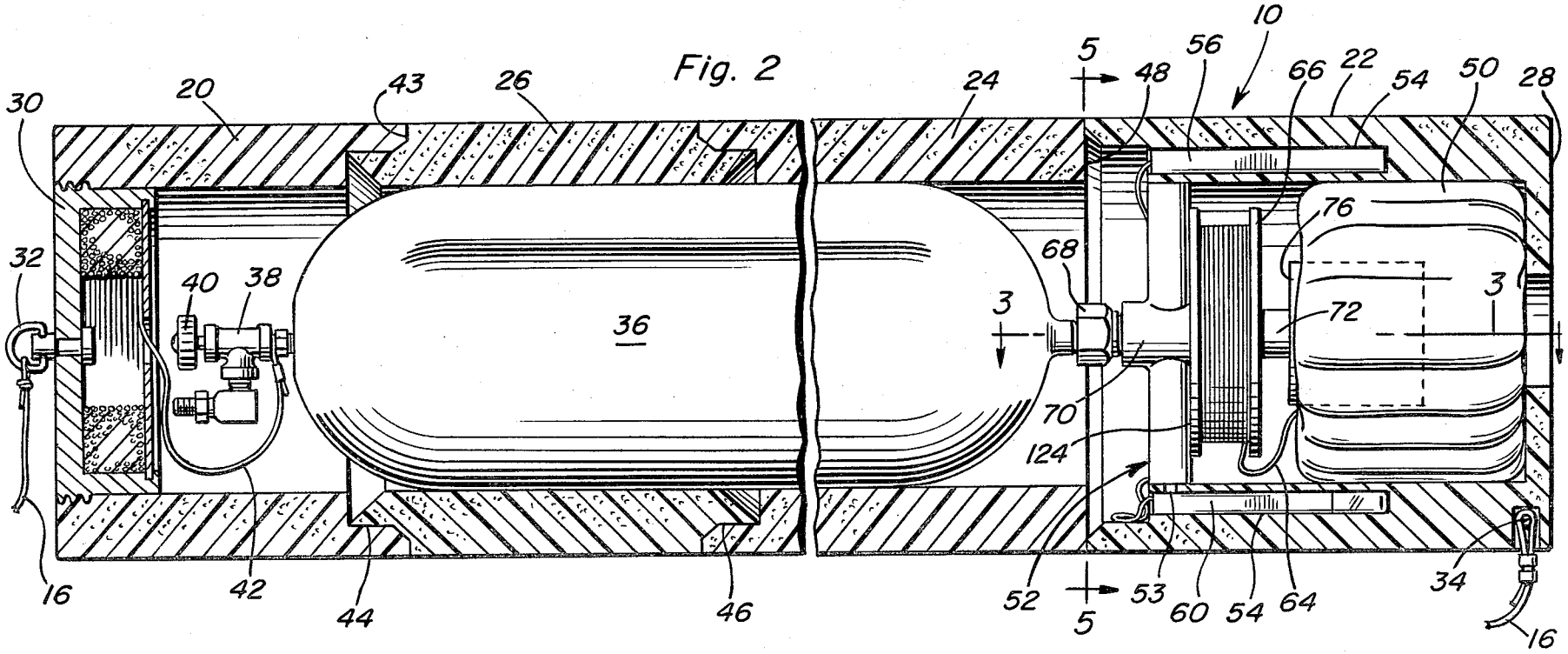
FIG. 2 is an enlarged partial side section view of the unit shown in FIG. 1, taken substantially through a plane indicated by section line 2—2 in FIG. 1.

The unit 10 has an outer package housing launching guide assembly, formed by axial end closure members 20 and 22, intermediate flotation positioning means in the form of a support collar 24 and a plurality of separable breakaway housing sections 26 held assembled between the end closure 20 and the flotation collar 24. In the illustrated embodiment, the housing assembly has an octagonal outer cross-section and forms a tubular enclosure between an end wall 28 of closure 22 and a cable storing plug member 30 of closure 20 as shown in FIG. 2. The anchoring cable 16 aforementioned is secured to the end closures 20 and 22 by means of any suitable fittings 32 and 34. The housing assembly is furthermore made of flotation material.

With continued reference to FIG. 2, the end closure 20 constitutes an inspection cover which is frictionally engaged with the breakaway housing sections 26 to hold the same assembled and is manually removable therefrom to expose the axial end of a compressed helium gas cylinder 36 forming part of a gas inflating mechanism protectively enclosed within the housing assembly. The cylinder may be refilled with pressurized gas through a filler valve fitting 38 that is opened or closed by means of valve handle 40 upon removal of inspection cover member 20. A cable 42 interconnects the cylinder 36 with the inspection cover member and maybe stored in the plug 30, for purposes to be explained hereinafter.

Figure 5:
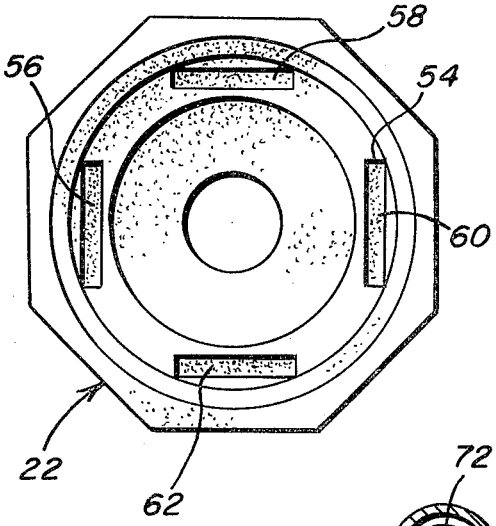
FIG. 5 is an end view of the signal cover as viewed from a plane indicated by section line 5—5 in FIG. 2.
Figure 6:
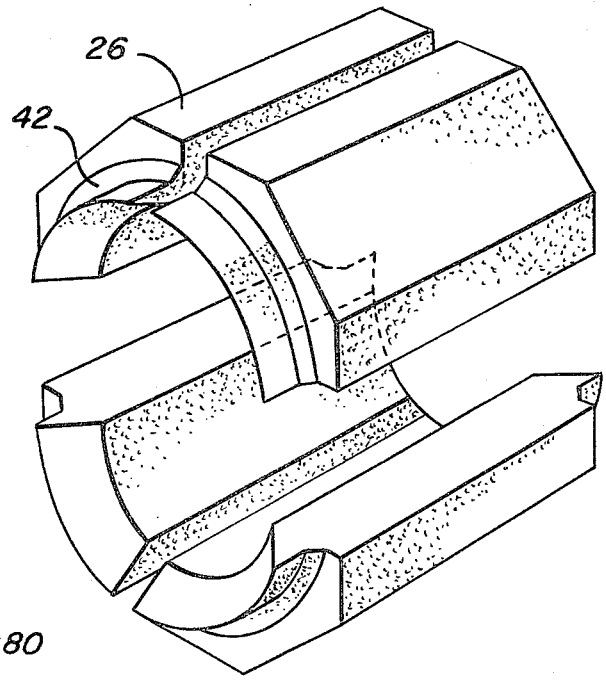
FIG. 6 is a perspective view of the disassembled breakaway housing section associated with the unit shown in FIGS. 1 and 2.
Figure 4:
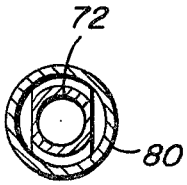
FIG. 4 is a partial transverse section view taken substantially through plane indicated by section line 4—4 in FIG. 3.
Figures 7A, 7B, 7C, 7D:
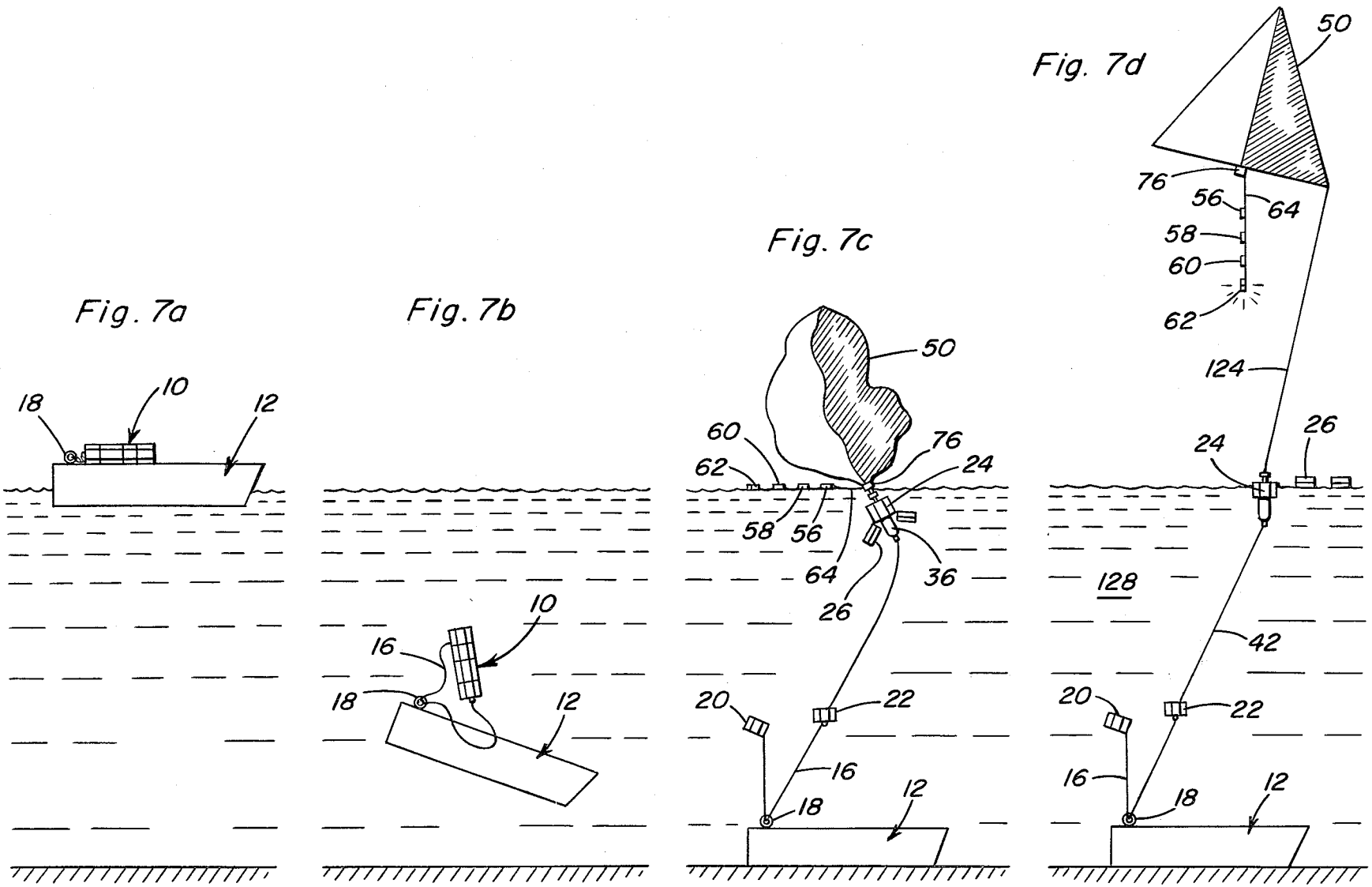

The breakaway housing sections 26 which may be four in number as more clearly seen in FIG. 6, have shouldered axial end portions 43 interfitted with the adjacent axial end portions 44 and 46 of the end cover 20 and positioning means or flotation collar 24 as shown in FIG. 2. When so interfitted, the sections 26 are held assembled to complete an enclosure for the cylinder. Removal of the inspection end cover 20 will therefore permit separation of the sections 26 from the cylinder 36 which remains tightly fitted within the flotation collar 24. The axial end 48 of collar 24 opposite recessed end portion 46, abuts the axial end of closure member 22 opposite the end wall 28. The closure member 22 constitutes a signal cover enclosing an inflatable aerial device or balloon 50 in a folded storage condition and releasable trigger means 52 for the inflating mechanism. The closure member 22 also has a plurality of axially elongated pockets 54 formed therein as shown in FIGS. 2 and 5, within which batteries 56 and 58, radio transmitter 60 and strobe signalling light 62 are retained. The components 56, 58, 60 and 62 form a signalling assembly that is held in a non-operating standby condition by the releasable trigger means 52 engaging a spring biased switch at 53 as long as the signal cover 22 is in engagement therewith as shown in FIG. 2. Further, the signalling components are electrically interconnected through switch 53 for operation of the radio transmitter 60 and strobe light 62 by the energy stored in batteries 56 and 58. These signalling components are interconnected by a cable 64 to the aerial balloon device 50.

Figure 3:
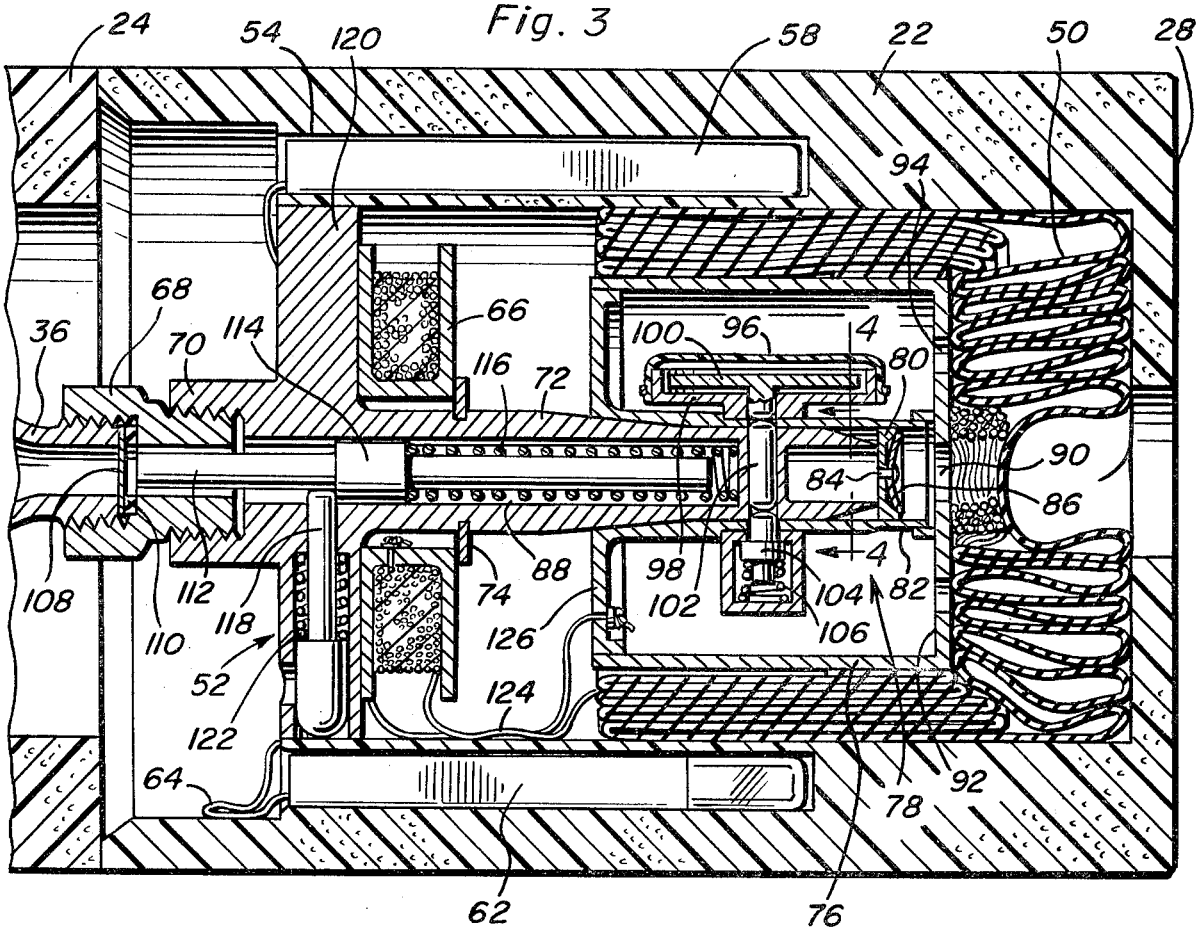
FIG. 3 is an enlarged partial section view taken substantially through a plane indicated by section line 3—3 in FIG. 2.

Referring now to FIG. 3 in particular, the axial end of the cylinder 36 projecting from the flotation collar 24 is threadedly connected by a coupling 68 to axial projection 70 on one side of the releasable trigger device 52 having an elongated tubular support 72 extending from the other axial side on which a cable storage 66 is held axially assembled by a retainer disc 74. Fixedly mounted on the tubular support 72 in axially spaced relation to the cable storage 66 is a gas inlet housing 76 for the aerial device 50 enclosing an inflation valve mechanism generally referred to be reference numeral 78. The valve mechanism includes a valve seat member 80 positioned within a tubular sleeve 82 positioning the housing 76 on the tubular support 72. The valve seat member abuts one axial end of the tubular support and is secured by a rivet 84 centrally to a flexible valve disc 86 biased to a valve closing position in peripheral engagement with the valve seat member. The valve disc operates as a one-way check valve between a gas flow conduit formed by central bore 88 in the tubular support 72 and inlet opening 90 in the end wall 92 of housing 76 which is also formed with openings 94 establishing fluid communication between the interior of housing 76 and the interior of the expandable material of balloon 50 secured to the housing 76 and stored in the axial space between the end walls 92 and 28 of the housing 76 and the signal cover 22. A pressure sensing diaphragm 96 within the housing 76 is mounted on a piston housing 98 secured to the sleeve 82 for displacement of a release piston element 100 and a locking pin 102 extending transversely through the tubular support 72. The locking pin 102 is biased by a locking piston 104 and spring 106 to the locking position shown in FIG. 3. Displacement of locking pin 102 by the piston element 100 in response to pressurization of the balloon 50 releases or uncouples the sleeve 82 and balloon 50 from the tubular support 72.

In the storage condition of the balloon as shown in FIG. 3, discharge of compressed gas from cylinder 36 into the bore 88 of the tubular support is blocked by a disc 108 of the inflating mechanism held assembled by a washer 110 within coupling 68. A puncture pin 112 having a piston portion 114 is slidably disposed within the bore 88 under the bias of a puncture spring 116. The puncture pin is held retracted against the bias of spring 116 by the releasable trigger device 52 which includes a retainer pin 118 slidably mounted within a transverse bore in an annular body 120 on which the signal cover 22 is supported. The retainer pin 118 is held in the position engaging the piston portion 114 of the puncture pin, as shown, by the signal cover. It will be apparent that upon removal of the signal cover from the body 120 of the trigger device, retainer spring 122 will retract retainer pin 118 enabling spring 116 to project the puncture pin against disc 108 to rupture it and initiate inflation of the balloon by discharge of pressurized gas into the bore 88 past the ruptured disc 108. Pressurization of the balloon uncouples it from the tubular support as aforementioned so that it is free to be launched into the atmosphere under the expanding action of the gas and its increasing air buoyancy. As the balloon rises, a cable 124 attached to the housing wall 126 is withdrawn from the cable storage 66 to which the cable 124 remains anchored.

The launching operation of the unit 10 is illustrated in FIGS. *7a*, *7b*, *7c* and *7d*. The unit 10 is carried by way of example, on a marine craft 12 to which it is anchored as shown in FIG. *7a*. Assuming that the craft 12 sinks under some emergency situation as shown in FIG. *7b*, the unit 10 being enclosed by flotation material begins to rise from the craft 12. The cable 16 anchored to craft 12 resists buoyancy forces exerted on the end covers 20 and 22 to pull them off the unit as the unit continues to rise under the buoyancy forces exerted on the flotation collar 24 as shown in FIG. *7c*. Removal of the end cover 20, causes the breakaway housing sections 26 to separate from the cylinder 36, while removal of end cover 22 initiates operation of the signalling components 56–62 which remain connected by cable 64 to each other and to the aerial balloon device 50. The signalling components are also withdrawn from the end cover 22 as the balloon and inflating device rise above end cover 22 which remains anchored therebelow to the craft 12 by means of cable 16. The balloon and inflating device rise to the surface and are operatively orientated or positioned upright as shown in FIG. *7d* by the flotation collar 24 for launching of the balloon into the atmosphere as shown in FIG. *7d*. The cable 124 pays out and the signalling components 56–62 are lifted by the balloon and remain suspended therefrom by cable 64 to emit radio signals from transmitter 60 and visual signals from strobe light 62 in order to indicate the location of the craft 12 submerged within the body of water 128 therebelow.

It will be apparent that the unit 10 may be carried in other types of craft or vehicles, including aircraft. Further, the unit may be triggered into operation by manual removal of signal end cover 22 initiating inflation of the balloon 50 and operation of the signalling components to launch the location indicating balloon 50 into the atmosphere from any location to which the inflating cylinder 36 remain anchored by cables 42 and 16.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In an emergency locating unit adapted to be carried on a vehicle, said unit having an inflatable aerial device disposed in a storage condition, inflating means for launching said aerial device into the air and releasable trigger means for triggering operation of said inflating means, the improvement residing in a launching guide assembly, comprising removable closure means engageable with the trigger means for preventing operation thereof, flotation positioning means mounted on the inflating means for operative orientation thereof during said launching of the aerial device, breakaway housing means engageable with the closure means and the positioning means prior to said launching of the aerial device for holding the launching guide assembly operatively assembled and the aerial device protectively enclosed therein in the storage condition, said closure means comprising a pair of end covers axially spaced from each other by the flotation positioning means and the breakaway housing means.

2. The combination of claim 1 including signalling means retained in a standby condition within the closure means, means responsive to separation of the closure means from the aerial device for triggering operation of the signalling means, and means coupling the aerial device to the signalling means for suspension from the aerial device in response to launching thereof.

3. The combination of claim 2 wherein the vehicle is a marine craft.

4. The combination of claim 1 including cable means for loosely anchoring the closure means to the vehicle.

5. The combination of claim 1 wherein said breakaway housing means comprises a plurality of separable sections held assembled in a tubular configuration by the flotation positioning means and the closure means.

6. In an emergency locating unit adapted to be carried on a marine craft, said unit having an inflatable serial device disposed in a storage condition, inflating means for launching said aerial device, and releasable trigger means for triggering operation of said inflating means, the improvement residing in a launching guide assembly, comprising removable closure means engageable with the trigger means for preventing operation thereof, positioning means mounted on the inflating means for operative orientation thereof during said launching of the aerial device, breakaway housing means engageable with the closure means and the positioning means prior to inflation of the aerial device for holding the launching guide assembly operatively assembled and the aerial device protectively enclosed therein in the storage condition, signalling means retained in a standby condition within the closure means, means responsive to separation of the closure means from the aerial device for triggering operation of the signalling means, and means coupling the aerial device to the signalling means for suspension from the aerial device when launched, said positioning means being a flotation collar.

7. The combination of claim 6 wherein said closure means comprises a pair of end covers axially spaced from each other by the positioning means and the breakaway housing means.

8. The combination of claim 7 wherein said breakaway housing means comprises a plurality of separable sections held assembled in a tubular configuration by the positioning means and the closure means.

9. The combination of claim 8 including cable means for anchoring the closure means to the marine craft and interconnecting the closure means with the inflating means.

10. In an emergency locating unit adapted to be carried on a marine craft, and having an inflatable aerial device disposed in a storage condition, inflating means for launching said aerial device into the air, and releasable trigger means for triggering operation of said inflating means, the improvement residing in a launching guide assembly, comprising removable closure means engageable with the releasable trigger means for preventing operation thereof, signalling means retained in a standby condition within the closure means, means responsive to separation of the closure means from the inflating means for triggering operation of the signalling means, means coupling the aerial device to the signalling means for suspension from the aerial device when launched to provide a locating signal and flotation means mounted on the inflating means for floatingly supporting the inflating means in the water following said separation of the closure means from the inflating means.

11. In a unit having an inflatable aerial device in a storage condition, inflating means for launching said aerial device into the air, and releasable trigger means for triggering operation of said inflating means, the improvement residing in a launching guide assembly, comprising removable closure means engageable with the releasable trigger means for preventing operation thereof, breakaway housing means engageable with the closure means to form an enclosure within which the aerial device is stored in the storage condition thereof and the inflating means is held assembled prior to said launching, and means responsive to removal of the closure means from the launching guide assembly for causing separation of the breakaway housing means from the inflating means.

12. The combination of claim 11 wherein said unit is carried on a marine craft to which the closure means is anchored.

13. The combination of claim 12 including flotation means mounted on the inflating means and held assembled between the closure means and the breakaway housing means for floatingly supporting the inflating means in water upon separation of the breakaway housing means therefrom.

14. The combination of claim 12 wherein said breakaway housing means comprises a plurality of separable sections held assembled in a tubular configuration by the flotation means and the closure means.

15. In combination with an emergency unit adapted to be carried on a craft for signalling the location thereof following submersion within a body of water, said unit having an inflatable aerial device disposed in a storage condition, inflating means for launching said aerial device into the air, and releasable trigger means for triggering operation of said inflating means, the immprovement residing in a launching guide assembly, comprising removable closure means engageable with the releasable trigger means for preventing triggering operation thereof, flotation means mounted on the inflating means for floating support thereof in a launching position during said launching of the aerial device, separable housing means held assembled by the closure means and the flotation means for protectively storing the inflating means and the aerial device prior to said launching thereof and means responsive to said submersion within the water for removing the closure means from the launching guide assembly to disengage the releasable trigger means and permit separation of the separable housing means from the inflating means, whereby the trigger means triggers operation of the inflating means to launch the aerial device from the launching position into the air under buoyancy forces.

16. In a flotation type of kit for locating a craft that has submerged into a body of water, which comprises a disintegrating form of housing for storage of the kit adapted for removable mounting on the craft, means for holding said housing on the craft, a float assembly including an inflatable device and a high pressure gas container connected thereto and adapted for storage within said housing, cable means connecting said float assembly to said craft, and gas release means positioned between said inflatable device and the gas container for inflation of the inflatable device upon release and unfolding thereof from the housing, the improvement residing in said housing having separable means secured to the gas container for floating support thereof in a launching position, removable closure means operatively connected to said housing, and means connecting the housing to the craft for resisting buoyancy forces exerted on the housing in response to submergence of the craft to cause removal of the closure means and disintegration of the housing and separation of said separable means therefrom with the gas container, whereby the inflatable device is launched into the air in response to said inflation thereof by the gas container in the launching position.

17. The improvement as defined in claim 16 wherein said inflatable device is an aerial lift balloon and said launching position is at the surface of the body of water.

18. The improvement as defined in claim 17 wherein said separable means is a flotation collar.

19. The improvement as defined in claim 18 wherein said housing further includes breakaway sections and said removable closure means includes end covers assembled with the flotation collar in enclosing relation to the gas container and the aerial lift balloon in deflated and folded condition during storage.

20. The improvement as defined in claim 19 wherein the cable means is secured to the gas container of the float assembly, and said buoyancy force resisting means comprises means anchoring the cable means to the end covers for causing disassembly of the breakaway sections and end covers of the housing and said separation of the flotation collar in response to the buoyance forces.

* * * * *